US005324901A

United States Patent [19]

Hendel et al.

[11] Patent Number: 5,324,901

[45] Date of Patent: Jun. 28, 1994

[54] CONTACT DEVICE FOR A CHANGER RELAY

[75] Inventors: Horst Hendel; Josef Kern, both of Berlin, Fed. Rep. of Germany

[73] Assignee: Siemens Aktiengesellschaft, Munich, Fed. Rep. of Germany

[21] Appl. No.: 828,794

[22] PCT Filed: Oct. 24, 1989

[86] PCT No.: PCT/DE89/00689

§ 371 Date: Jan. 30, 1992

§ 102(e) Date: Jan. 30, 1992

[87] PCT Pub. No.: WO91/06964

PCT Pub. Date: May 16, 1991

[51] Int. Cl.[5] ..... H01H 1/00

[52] U.S. Cl. ..... 200/238; 200/271; 200/275

[58] Field of Search ..... 200/271, 287, 275, 239, 200/238

[56] References Cited

U.S. PATENT DOCUMENTS 3,930,211 12/1975 Belttary ..... 375/6

4,647,743 3/1987 Kern et al. ..... 200/275

FOREIGN PATENT DOCUMENTS 0136592 4/1985 European Pat. Off. .

0167668 1/1986 European Pat. Off. .

1665958 4/1971 Fed. Rep. of Germany .

1158119 7/1969 United Kingdom .

*Primary Examiner*—Henry J. Recla

*Assistant Examiner*—David J. Walozak

*Attorney, Agent, or Firm*—Hill, Steadman & Simpson

[57] ABSTRACT

A contact arrangement for a change-over contact relay has a movable contact spring (2), on the free end (3) of which switching contact pieces (5, 6) are arranged on both sides, the current to be switched being supplied via an electrical connecting line (9) to the switching contact pieces (5, 6). [2.2] In order to permit a mass distribution, which is as symmetrical as possible, in the region of the free end (3) of the contact spring (2) and a supply, which is as loss-free as possible, of the current to be switched to the switching contact pieces (5, 6), [it is provided that] the switching contact pieces (5, 6) are connected directly in an electrically conducting manner to the one end (8) of the electrical connecting line (9). For this purpose, the one end (8) of the connecting line (9) or a switching contact piece (5, 6) preferably has an extension piece, the end face of which forms a joining face for the purpose of producing the electrically conducting connection.

7 Claims, 3 Drawing Sheets

CONTACT DEVICE FOR A CHANGER RELAY

BACKGROUND OF THE INVENTION

1. Field of the Invention

The invention relates to a contact arrangement for a change-over contact relay having a movable contact spring which bears at its free end a switching contact piece on each side and has a recess in the region of the switching contact pieces, a stranded conductor-shaped connecting line being connected directly in an electrically conducting manner to at least one of the contact pieces.

2. DESCRIPTION OF THE RELATED ART

In a known contact arrangement as shown in European Application (01 67 688) of this kind for a change-over contact relay of high switching capacity, a contact spring which can be moved between two corresponding contact elements is provided at its free end with two switching contact pieces arranged on both sides. The first switching contact piece arranged on the one side of the movable contact spring is connected directly to an electrical connecting line constructed as a stranded copper conductor so that the contact spring itself does not conduct the current to be switched. In order to provide a contacting face which is sufficient for the connection of the electrical connecting line to the first switching contact piece, the latter is made so long that it projects beyond the width of the free end of the movable contact spring. The second switching contact piece arranged on the other side of the free end of the contact spring corresponds in its width approximately to the width of the free end of the contact spring. In the known contact arrangement, this comparatively short switching contact piece is either soldered to the contact spring or connected by means of an extension piece to the first comparatively long switching contact piece. In both variants, the current to be switched flows in each contact-making position of the contact spring via the long switching contact piece so that the latter experiences a greater degree of heating in comparison with the short switching contact piece. If the current to be switched flows to the short switching contact piece, it has to pass at least two connections. However, each connection constitutes an increased ohmic resistance which causes an electrical loss power. The differently constructed switching contact pieces give rise to a non-symmetrical mass distribution which is manifested in particular in an unfavorable dynamic behavior during the switching processes, for example in an increased inclination to bouncing. Due to the long switching contact piece, the known contact arrangement requires a substantially higher amount of noble metal in comparison with the amount of noble metal required for the pure contact-making faces of the switching contact pieces. Furthermore, the manufacture and processing of switching contact pieces of different lengths increases the manufacturing costs for the known contact arrangement.

German application 1 6651958 discloses a contact arrangement in which a contact spring bears a contact piece on both sides. A further U-shaped leaf spring serves here as a connection for the current supply so that double the thickness of the leaf spring exists in the region of the contact pieces. However, this leaf spring for the current supply exerts additional forces on the contact spring; for this reason, it is also limited in cross-section and thus cannot conduct currents of any desired strength. Because of its leaf spring shape, it cannot be bent into any desired direction either, and is thus only to be used for quite specific contact spring arrangements. British application 1 158 119 shows a contact spring arrangement with contact pieces mounted on both sides, which pieces are soldered to one another through a hole in the contact spring. However, a separate current supply is not provided in this publication.

SUMMARY OF THE INVENTION

The object of the invention is to provide a substantially improved operation behavior in a contact arrangement of the type mentioned at the beginning while substantially lowering the manufacturing costs.

This object is achieved in a contact arrangement constructed according to the present invention which has the following features:

the contact spring bears at its free end one switching contact piece on each side, in the region of the switching contact pieces the contact spring has a recess, or opening a stranded conductor-shaped connecting line is connected by its end, which is stamped into a plate shape, to a flat side of the free end of the contact spring, a first contact piece is directly connected in an electrically conducting manner to the connecting line on the side of the connecting line facing away from the contact spring and a second switching contact piece is arranged on the side of the contact spring lying opposite the connecting line and is also directly connected in an electrically conducting manner to the connecting line via the recess, or opening.

An advantage of the present invention is that the current to be switched flows in every contact-making position of the contact spring to the respective switching contact piece via only a single joining point or electrical connection. Because, for each switching contact piece, only the contact face of the respective connection is to be provided with the one end of the electrical connecting line, the amount of noble metal required by the first switching contact piece is considerably reduced and a non-uniform heating of the two switching contact pieces of the contact arrangement according to the invention is advantageously avoided. In addition, as a result of the approximately identical construction of the switching contact pieces, a substantially more favorable, i.e. more uniform mass distribution is obtained in the region of the free end of the contact spring.

An advantageous development of the contact arrangement according to the invention provides for at least one of the further switching contact pieces to have an extension piece which is connected in an electrically conducting manner to the one end of the electrical connecting line. With an extension piece of this kind, on the one hand, a defined region for forming the electrically conducting connection is advantageously provided and, on the other hand, the thickness of the contact spring can optionally be spanned by means of this extension piece.

A further advantageous development of the contact arrangement according to the invention consists in the fact that the one end of the electrical connecting line has an extension piece which is connected in an electrically conducting manner to the at least one further switching contact piece. A design of this kind of the contact arrangement according to the invention has the advantage that switching contact pieces constructed in completely the same manner are used; this is favorable from an economic point of view due to the thus increased number of identical switching contact pieces. The extension piece of the one end of the electrical connecting line can be manufactured for example by stamping after the one end of the electrical connecting line has been compressed in a welding process. It is also conceivable for both the second switching contact piece and the one end of the electrical connecting line each to have extension pieces whose sum corresponds to the thickness of the contact spring.

A further advantageous development of the contact arrangement according to the invention provides for the extension piece to engage through a recess in the free end of the contact spring. With a recess of this kind, the positioning of the extension piece is advantageously simplified so that overall a higher production quality can be achieved.

An advantageous development of the contact arrangement according to the invention provides for the extension piece to be mounted in the recess. Thus, during the production process, a constructional unit, which is advantageous for example with respect to handling during production, is formed between the element —namely the one end of the electrical connecting line and/or the second switching contact piece—which has the extension piece, and the contact spring.

A further advantageous development of the contact arrangement according to the invention is that the electrically conducting connections are weld connections, and the switching contact pieces have in the region of their weld zones a coating which improves the weld behavior. In this way, the mechanical quality and the conductivity of the weld connection between the respective switching contact pieces and the one end of the electrical connecting line is further improved, by which means a reduction of the ohmic resistance in these regions is achieved and thus the heating of the switching contact pieces or of the entire contact arrangement whilst the current to be switched flows is further reduced.

The contact arrangement according to the invention is distinguished overall by a considerable reduction of the masses to be moved during the switching processes, which on the one hand has a favorable effect on the dynamic behavior of the contact arrangement and on the other hand makes smaller drive forces necessary.

BRIEF DESCRIPTION OF THE DRAWINGS

The invention is explained in greater detail below in exemplary embodiments with reference to the drawing, in which.

DETAILED DESCRIPTION OF THE PREFERRED EMBODIMENTS

Figure 1:
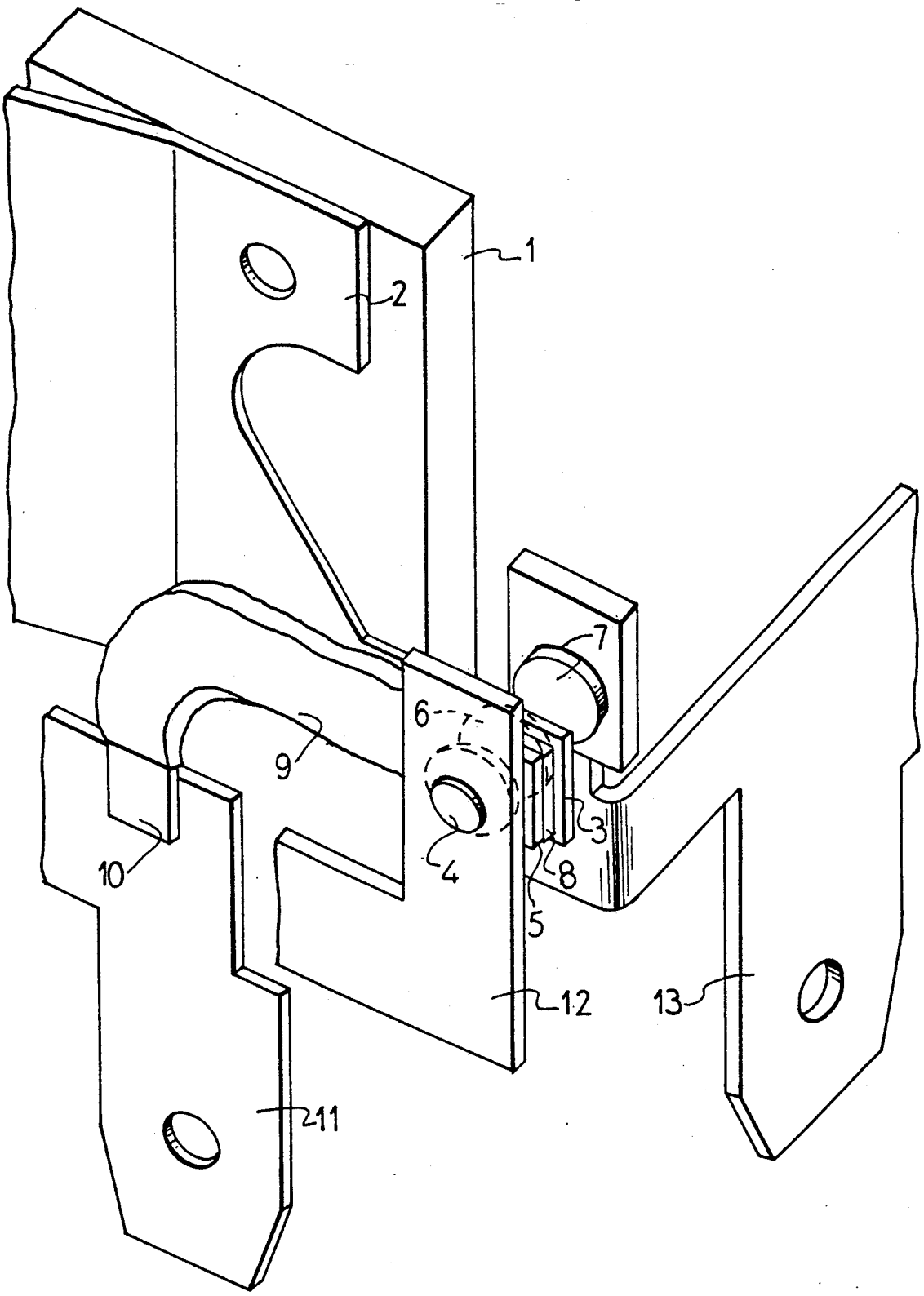
FIG. 1 shows a contact arrangement designed according to the invention.

The contact arrangement illustrated diagrammatically in FIG. 1 is part of a relay as generally described for example in the German Utility Model 83 25 986 with its magnet system. A contact spring 2 is mounted on an armature 1 illustrated in outline. The contact spring 2 has a free end 3 which serves as a center contact spring in a change-over contact relay. The contact spring 2 or its free end 3 assumes two stable positions depending on the position of the armature 1. In the first stable position (illustrated in FIG. 1), a corresponding contact element 4 forms a closed electrical contact with a switching contact piece 5. In the second stable position of the free end 3 of the contact spring 2, a second switching contact piece 6 forms a closed electrical contact (FIG. 1 shows this contact in the open state) with a further corresponding contact element 7. One end 8 of an electrical connecting line 9 constructed as a stranded copper conductor is located between the switching contact pieces 5 and 6. The other end 10 of the electrical connecting line 9 is connected to a connecting element 11. The corresponding contact elements 4 and 7 are also each connected to connecting elements 12 and 13, respectively, which emerge through a base, not illustrated in FIG. 1, of the change-over contact relay as external connections.

Figure 2:
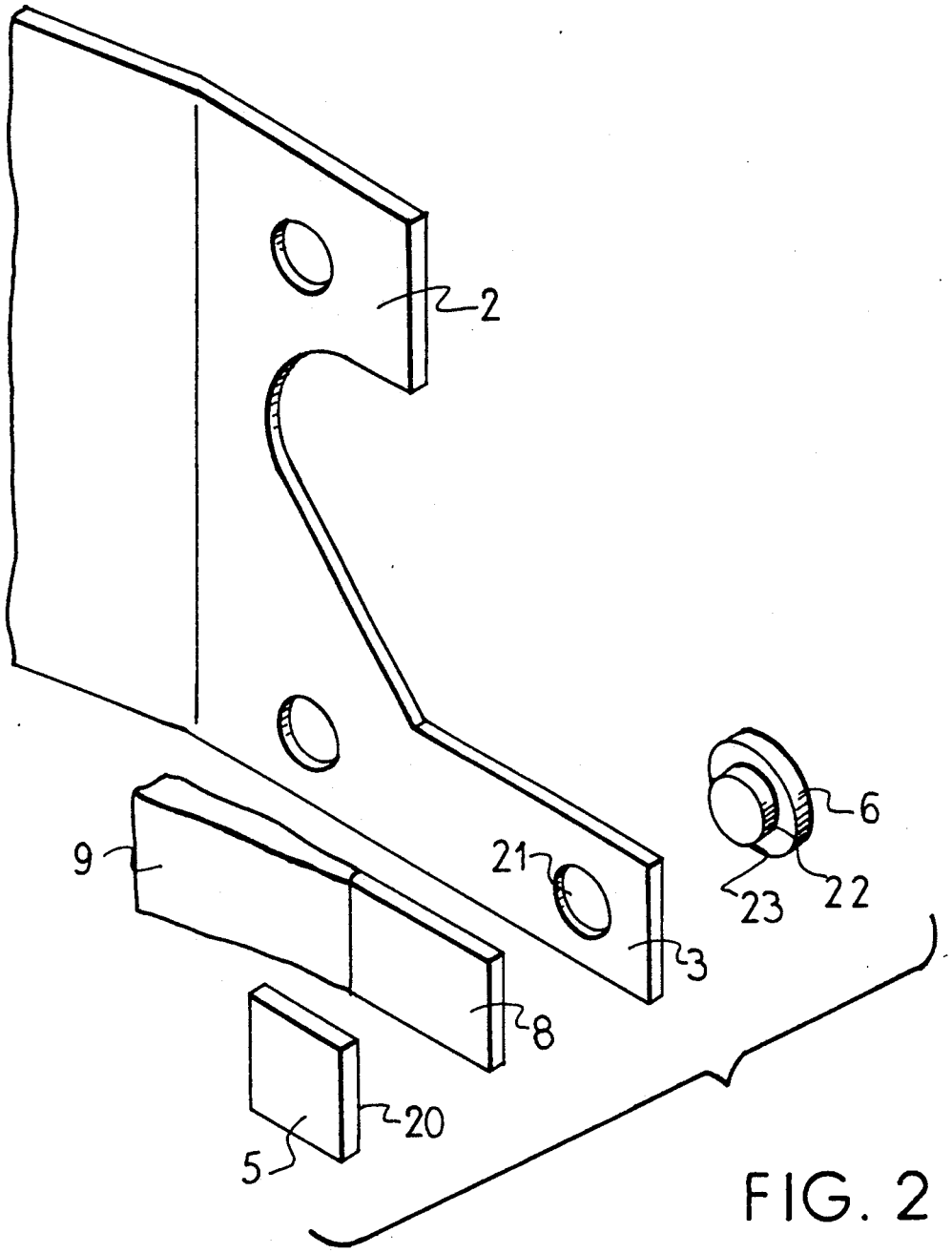
FIG. 2 shows details of the design of the free end of the contact spring with the switching contact pieces.

In FIG. 2, the region of the free end 3 of the contact spring 2 is shown in an exploded view. The one end 8 of the electrical connecting line 9 has been compressed in a welding process and has a plate-shaped form. On the one side of the one end 8 of the electrical connecting line 9 there is the rectangular switching contact piece 5 which is coated on its surface facing the one end 8 with a thin silver layer 20. The free end 3 of the contact spring 2 has a recess 21 through which an extension piece 22 of the switching contact piece 6, constructed in a rivet-like manner, engages in the joined state.

The end face of the extension piece 22 is also coated with a silver layer 23.

Figure 3:
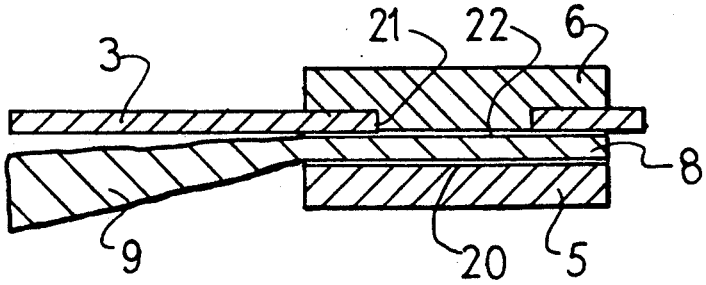
FIG. 3 shows a section through FIG. 2 in the region of the switching contact pieces.

FIG. 3 shows a section through FIG. 2 in the region of the switching contact pieces in the joined state. By means of the coating with the silver layers 20 and 23, a large-area, high-quality weld connection to the one end 8 of the electrical connecting line 9 is produced after the switching contact pieces 5 and 6 are joined so that current is conducted in largely low-loss fashion between the electrical connecting line 9 and the respective contact-making switching contact piece 5 or 6. A largely symmetrical distribution of the overall mass can be seen in the region of the switching contact pieces 5 and 6.

If the switching contact piece 5 connects to the corresponding contact element 4 (first stable position of the contact spring 2), the current to be switched flows via the connecting element 11, via the electrical connecting line 9, the one end 8 of the electrical connecting line and the (single) electrical connection between the one end 8 and the switching contact piece 5 and via the connecting element 12 (see FIG. 1). In the same way, in the second stable position of the contact spring 2, the current to be switched follows a corresponding path via the (single) electrical connection of the switching contact piece 6 to the one end 8 of the electrical connecting line 9 to the connecting element 13.

Figure 4:
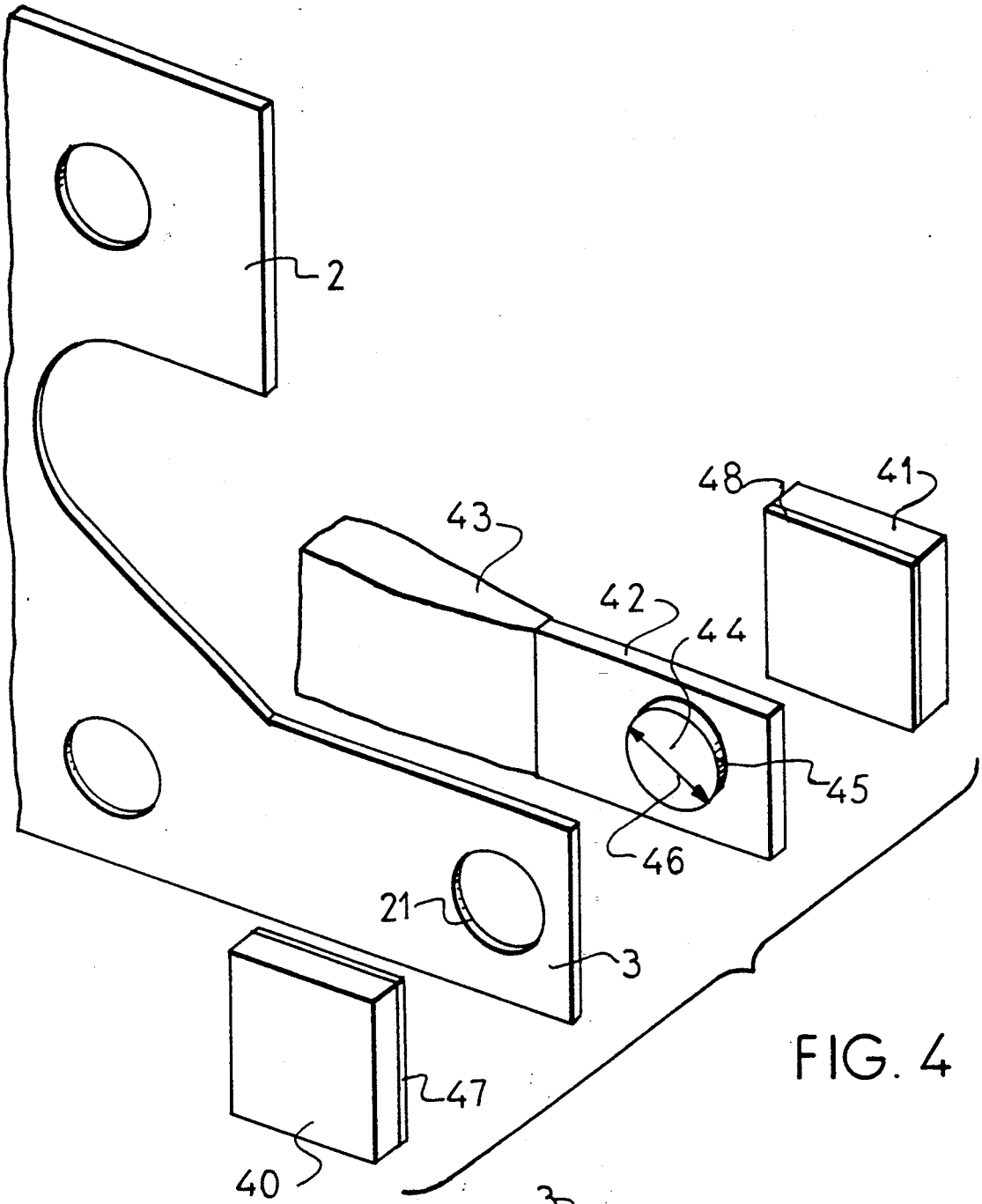
FIG. 4 shows details of a further possible design of the free end of the contact spring with the two switching contact pieces and FIG. 5 shows a section in FIG. 4 in the region of the switching contact pieces.

In FIG. 4, a further detail of the contact arrangement is shown in an exploded view in which a switching contact piece 40 and a second switching contact piece 41 are of identical construction. Between the switching contact pieces 40 and 41 there is one end 42 of an electrical connecting line 43 which is provided with an extension piece 44 by corresponding stamping when it is being compressed. The extension piece 44 is matched in its height 45 to the thickness of the free end 3 of the contact spring 2 and in its diameter 46 to the diameter of the recess 21. Surfaces 47 and 48, facing the one end 42 of the electrical connecting line 43, of the switching contact pieces 40 and 41, respectively, are equipped with a welding aid in the form of a silver-containing layer.

Figure 5:
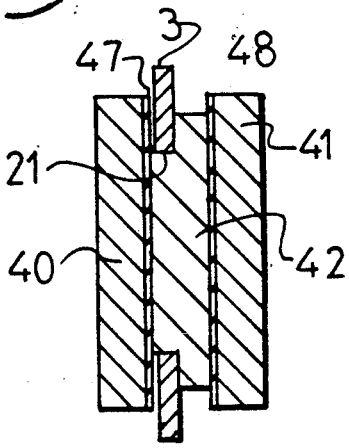

In FIG. 5, the elements described in conjunction with FIG. 4 are illustrated in section in the joined state. The extension piece 44 is connected to the recess 21 of the contact spring 2 by pre-riveting before the connection between the switching contact pieces 40 and 41 is produced by welding with the one end 42 of the electrical connecting line 43 or the extension piece 44. In this exemplary embodiment, the switching contact pieces 40 and 41 can be cut from the same ribbon material in lengths which remain the same, it being possible for the ribbon material to consist for example of a copper alloy coated on one side (contact face) with a noble metal and already coated on its other side with the welding aid. In addition, as a result of the identical design of the switching contact pieces 40 and 41, a particularly symmetrical construction of the contact arrangement is obtained.

Although other modifications and changes may be suggested by those skilled in the art, it is the intention of the inventors to embody within the patent warranted hereon all changes and modifications as reasonably and properly come within the scope of their contribution to the art.

We claim:

1. A contact arrangement for a change-over contact relay, comprising:

a movable contact spring having a free end, an opening extending through said contact spring adjacent said free end, a stranded conductor connecting line having strands at an end thereof stamped into a plate shape, said stamped end being connected to a flat side of said free end of said contact spring so as to obscure said opening, a first contact piece directly connected in an electrically conducting manner to said stamped end of said connecting line on a side of said stamped end of said connecting line facing away from said contact spring and a second contact piece arranged on a side of said contact spring lying opposite said stamped end of said connecting line and directly connected in an electrically conducting manner to said stamped end of said connecting line through said opening.

2. A contact arrangement as claimed in claim 1, wherein said second switching contact piece includes an extension piece extending through said opening of said contact spring and connected directly to said stamped end of said connecting line.

3. A contact arrangement as claimed in claim 2, wherein said extension piece is mounted in said opening.

4. A contact arrangement as claimed in claim 1, wherein said electrical connecting line comprises an extension piece extending through said opening of said contact spring and connected directly to the second switching contact piece.

5. A contact arrangement as claimed in claim 4, wherein said extension piece is mounted in said opening.

6. A contact arrangement as claimed in claim 1, wherein solder connections including a coating are provided at each of said electrically conducting connections.

7. A contact arrangement as claimed in claim 1, wherein said first and second contact pieces each have a length in a direction perpendicular to a pivot axis of said contact spring substantially equal to a width of said free end of said contact spring in said direction.

* * * * *